US005554491A

United States Patent [19]

O'Toole et al.

[11] Patent Number: 5,554,491

[45] Date of Patent: Sep. 10, 1996

[54] USE OF AN ALKALINE PREBATH TO ACTIVATE AN ACIDIC PEROXIDE BLEACH SOLUTION FOR PROCESSING COLOR PHOTOGRAPHIC ELEMENTS

[75] Inventors: Terrence R. O'Toole, Webster, N.Y.; Mark F. Sistare, Carrboro, N.C.

[73] Assignee: Eastman Kodak Company, Rochester, N.Y.

[21] Appl. No.: 407,937

[22] Filed: Mar. 21, 1995

[51] Int. Cl.[6] ..... G03C 7/00; G03C 5/18; G03C 5/26; G03C 5/49

[52] U.S. Cl. ..... 430/393; 430/430; 430/427; 430/432; 430/943

[58] Field of Search ..... 430/393, 430, 430/432, 427, 943, 376, 383

[56] References Cited

U.S. PATENT DOCUMENTS

| | | | |
|---|---|---|---|
| 4,277,556 | 7/1981 | Koboshi et al. | 430/393 |
| 4,301,236 | 11/1981 | Idota et al. | 430/393 |
| 4,328,306 | 5/1982 | Idota et al. | 430/393 |
| 4,469,780 | 9/1984 | Hirai et al. | 430/373 |
| 5,436,118 | 7/1995 | Carli et al. | 430/398 |

FOREIGN PATENT DOCUMENTS

| | | |
|---|---|---|
| 0428101A1 | 5/1991 | European Pat. Off. . |
| 0509382A2 | 10/1992 | European Pat. Off. . |
| 07300 | 4/1992 | WIPO . |

*Primary Examiner*—Charles L. Bowers, Jr.
*Assistant Examiner*—J. Pasterczyk
*Attorney, Agent, or Firm*—J. Lanny Tucker

[57] ABSTRACT

Color photographic elements can be effectively and rapidly bleached using acidic peroxide bleaching solutions when an alkaline prebath solution is used to activate the acidic bleaching solution.

22 Claims, 1 Drawing Sheet

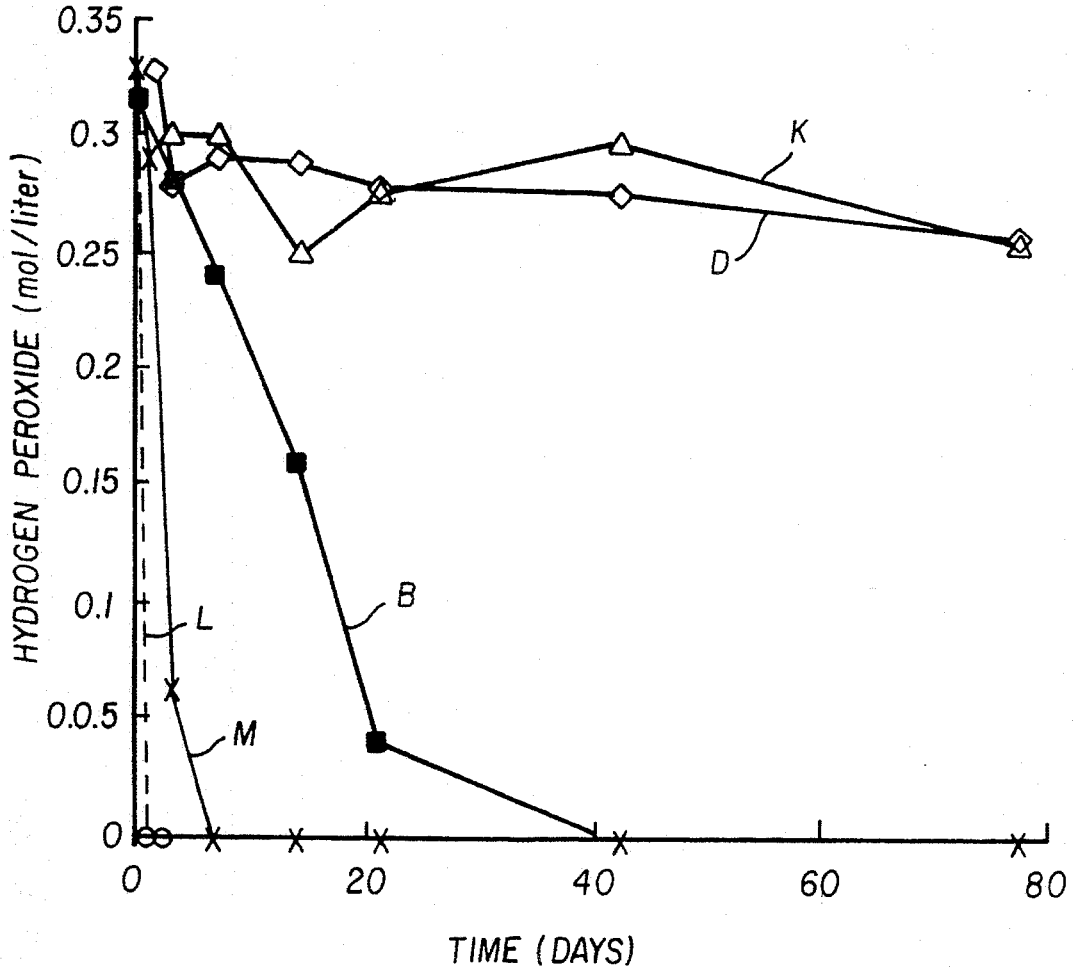
0.35
0.3
0.25
0.2
0.15
0.1
0.0.5
0
HYDROGEN PEROXIDE (mol/liter)
K
D
B
L
M
0
20
40
60
80
TIME (DAYS)

USE OF AN ALKALINE PREBATH TO ACTIVATE AN ACIDIC PEROXIDE BLEACH SOLUTION FOR PROCESSING COLOR PHOTOGRAPHIC ELEMENTS

FIELD OF THE INVENTION

The present invention relates generally to the processing of color photographic elements. More particularly, it relates to the use of acidic peroxide bleaching solutions and an alkaline prebath to activate the peroxide bleaching agent. The method of this invention is useful in the field of photography.

BACKGROUND OF THE INVENTION

During processing of silver halide color photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions that are more compatible with the environment. Thus it is desirable to reduce or avoid the use of ferric complexes as bleaching agents.

Peracid bleaching solutions, such as those containing peroxide and persulfate bleaching agents, offer an alternative to the ferric complex bleaching solutions. They are less expensive and present lower chemical and biological demands on the environment since their by-products are less harmful.

While persulfate bleaching agents have low environmental impact, they have the disadvantage that their bleaching activity is slow and thus requires the presence of a bleaching accelerator. However, the most useful accelerators are thiols that have undesirable odors.

Because hydrogen peroxide reacts and decomposes to form water, a peroxide-based bleaching solution offers many environmental advantages over persulfate and ferric complex bleaching solutions. Many publications describe peroxide bleaching solutions, including U.S. Pat. No. 4,277,556 (Koboshi et al). The described peroxide bleaching agents are catalyzed by various metal ions and are generally stable in an acidic environment. However, these acidic bleaching solutions are not rehalogenating or silver retentive (that is, the developed silver can be oxidized to a soluble salt, and undeveloped silver halide remains in the element).

Because of the toxicity of silver, its level in effluent is highly regulated, and photofinishers are often required to recover silver from the fixing solution. Photofinishers would rather not have to recover silver from both a bleaching solution and a fixing solution because of the added expense. Thus, it is desirable that the bleaching solution be silver retentive by containing halide ion. Yet, raising the level of halide ion in the bleaching solution to make it silver retentive, deactivates the bleaching agent under these acidic conditions.

U.S. Pat. No. 4,301,236 (Idota et al) and U.S. Pat. No. 4,328,306 (Idota et al) describe acidic peroxide bleaching solutions that contain a ferric complex catalyst. The bleaching solutions are silver retentive, but the presence of the iron destabilizes the system because iron is a well-known catalyst for peroxide decomposition.

WO-A-92/07300 (published Apr. 30, 1992) and EP 0 428 101A1 (published May 22, 1991) generally describe alkaline peroxide bleaching solutions that are rehalogenating. Although these alkaline solutions are quite active toward silver oxidation, they suffer from poor stability and are considered useful only with high chloride (>90 mole %) silver halide emulsions.

Despite all of the efforts of researchers in the art, no peroxide bleaching solution or method has been commercialized because of the various problems including vesiculation (blistering of the photographic element from the evolution of oxygen), poor bleaching efficiency and instability.

There remains a need, therefore, for highly efficient peroxide bleaching that does not suffer from the problems noted above. Particularly, it is desirable that such bleaching be carried out with stable solutions (that is, solutions that suffer little decomposition of the peroxide), and be highly efficient in bleaching a variety of photographic elements including those having emulsions having <90 mole % silver chloride.

SUMMARY OF THE INVENTION

The problems noted above have been overcome with a method for processing a color photographic element, comprising:

A) treating an imagewise exposed and developed color photographic element with an alkaline prebath solution, and B) bleaching the treated element with an acidic, rehalogenating peroxide bleaching solution.

The method of this invention provides rapid and efficient bleaching of imagewise exposed and developed color photographic elements, and avoids the problems encountered with conventional peroxide bleaching methods. The bleaching solution used in this invention is acidic and highly stable.

Both critical solutions used in this invention are simple, inexpensive and harmless to the environment.

In the present invention, the function of the alkaline prebath is to poise the pH and buffering capacity of the photographic element being processed high enough so that, when the element is immersed in the acidic bleaching solution, silver oxidation can occur under favorable alkaline conditions before the pH of the element drops to the pH of the acidic bleaching solution. The buffering capacity of the photographic element can arise from an imbibed solution buffer (such as a carbonate salt) or from the gelatin binder matrix itself. The pH buffering capacity of gelatin is well known (James, *The Theory of the Photographic Process,* 4th Ed., MacMillan Publishing, New York, pp. 56–57, 1977). As described below in more detail, the buffering capacity of the acidic bleaching solution must be kept low enough so that the rate of silver oxidation is greater than the rate of pH neutralization.

BRIEF DESCRIPTION OF THE DRAWINGS

The FIGURE is a graphical representation of stability data of several bleaching solutions over time as described in Example 11 below.

DETAILED DESCRIPTION OF THE INVENTION

In the practice of the present invention, an imagewise exposed and developed color photographic element is treated first with an alkaline prebath solution (also identified herein as a "prebath solution" or an "activator" solution), followed by bleaching as described below.

In one embodiment of this invention, the "prebath solution" is also a color developing solution that contains a color developing agent and other materials generally included in such solutions. Such materials are well known in the art, including the *Research Disclosure* publication identified herein below.

Thus, the prebath solution can optionally contain one or more conventional color developers (such as a phenylenediamine), black and white developers (such as a hydroquinone or ascorbate), antioxidants (such as sulfite, triethanolamine, substituted or unsubstituted hydroxylamines or hydrazide), optical brighteners (such as stilbenes), chelating agents (such as polyaminocarboxylates), surfactants, fixing accelerators, biocides or stabilizers (including hydrogen peroxide stabilizers, such as phosphates, phosphonates, stannates and other compounds described in EP 0 509 382A2 (published Oct. 21, 1992), as long as such materials do not adversely affect the solution pH.

In a second and preferred embodiment, the "prebath solution" is not the color developing solution, but is used following the color development step (and an optional development stop step) as a separate treatment step prior to bleaching.

In the following discussion of the alkaline prebath solution, both embodiments described above are to be kept in mind, unless otherwise indicated.

The prebath solution has a pH greater than 7. Generally, the pH is from about 8 to 14, and preferably it is from about 9 to about 13. Most preferably, the pH is from about 10 to about 11.

The prebath solution can optionally contain one or more suitable buffers to maintain the alkaline pH. Useful buffers generally have at least one $pK_a$ between 7 and 14, and can be inorganic salts including, but not limited to, carbonates, phosphonates, borates, calcium hydroxide, and silicates, or organic compounds including, but not limited to, aliphatic amines, imines, amino acids, carboxylates and phosphonic acids. The buffer concentration can be from about 0.001 to about 5 mol/l with from about 0.01 to about 1 mol/l being preferred.

The pH can be adjusted to the desired value with strong or weak acids or bases. Examples of strong acids include, but are not limited to, sulfuric acid, nitric acid and hydrochloric acid, and examples of strong bases include but are not limited to, sodium hydroxide and potassium hydroxide. The amount of strong or weak base that may be used would be readily apparent to one skilled in the art.

Where anionic or cationic buffers are used, suitable cations or anions, respectively, can be present. Thus, representative buffers include, but are not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylendiaminedisuccinic acid, glycine, histidine, imidazole, isoleucine, leucine, methyliminodiacetic acid, nicotine, nitrilotriacetic acid, piperidine, proline, purine and pyrrolidine. Sodium carbonate and potassium carbonate are most preferred as buffers.

After color development in the second embodiment described above, the photographic element is treated with the prebath solution for at least 2 seconds, and preferably for at least 5 seconds. A more preferred treatment time is from about 10 to about 60 seconds, but a skilled worker could determine an optimum treatment time with routine experimentation. Treatment is usually carried out at a temperature of from about 20° to about 45° C.

Following treatment with the prebath solution, the element optionally can be washed for up to 2 minutes with water (preferably nonbuffered) having a low ion content. Tap water can be used, but distilled or deionized water is preferred. Preferably, this wash step is less than 1 minute. The wash solution can also contain one or more optical brighteners, peroxide stabilizers, surfactants, fixing accelerators and other conventional addenda as long as the level of ions is negligible and the pH environment of the element is not adversely affected.

Following treatment with the prebath solution (either the first or second embodiment described above), the element is then processed in an acidic peroxide bleaching solution. The peroxide bleaching agent can be hydrogen peroxide or a compound that releases hydrogen peroxide (such as a percarbonate, perborate, percarboxylic acid, or peroxide urea complex or other percarbamides). Hydrogen peroxide can also be generated on site by electrochemical means. Preferably, the bleaching agent is hydrogen peroxide.

The bleaching agent is present in an amount of at least about 0.05 mol/l with amounts of from about 0.1 to about 3 mol/l being preferred. More preferred amounts are from about 0.1 to about 1 mol/l.

Also included within the bleaching solution is chloride ion as a halogenating agent in an amount of from about 0.001 to about 1 mol/l, with amounts of from about 0.01 to about 0.5 mol/l being preferred. Most preferred amounts are in the range of from about 0.035 to about 0.35 mol/l. The chloride ion can be supplied as part of a common inorganic or organic salt, the alkali metal or ammonium salts being preferred.

The pH of the bleaching solution is generally from about 2 to about 7, but the preferred pH is from about 3 to about 6. Solution pH can be achieved by adding one or more suitable weak or strong acids, and one or more buffers can be included if desired to maintain the desired pH. Useful buffers generally have at least one $pK_a$ between 2 and 7, and can be inorganic salts such as sulfates, phosphates, sulfamates and borates, or organic compounds such as carboxylic acids, amino acids and phosphonic acids. Representative useful buffers include, but are not limited to, acetic acid, succinic acid, hydroxyacetic acid, sulfosuccinic acid, maleic acid, formic acid, phthalic acid, glycine, phosphoric acid and sulfuric acid. The amount of bases or buffers to be used would be readily apparent to one skilled in the art.

It is also important for the optimum bleaching effectiveness in the practice of this invention that the bleaching solution have a buffer capacity, $C_A$, of less than about 0.05 mol/l, and preferably less than about 0.01 mol/l. Buffer capacity is defined by the following equation:

$$C_A=[H^+]+[HA]$$

wherein $[H^+]$ is the molar concentration of the free hydronium ion, and [HA] is the total molar concentration of optional buffers in the conjugate acid form, that is, the proton-bearing form. The term [HA] is readily calculated for any buffer (which readily dissociates in water) at a specific pH from standard acid-base equilibrium equations and known acid dissociation constants. Further details regarding these terms and the necessary calculations can be obtained from any elementary college chemistry textbook or chemistry handbook, such as *CRC Handbook of Chemistry and Physics*, 75th Edition, 1994.

Both the action of the bleaching solution and the carry-over from the alkaline prebath solution will tend to cause the pH of the bleaching solution to rise. In order to ensure that the pH remains between about 2 and about 7 (preferably from about 3 and about 6), some buffer capacity is desirable in the bleaching solution. This will depend upon the pH, buffer concentration and replenishment rate of the bleaching solution. However, if the $C_A$ is too high, bleaching efficiency is compromised.

Generally, the maximum $C_A$ that will permit complete bleaching is dependent upon a number of factors: lower chloride and higher peroxide concentrations in the bleaching solution, and higher pH and buffer concentration in the alkaline prebath solution permit higher $C_A$ of the bleaching solution. Conversely, higher chloride and lower peroxide concentrations in the bleaching solution, and lower pH and buffer concentration in the alkaline prebath solution will tend to require a lower maximum $C_A$.

The bleaching solution can also contain one or more addenda as described above for the alkaline prebath and wash solutions, as would be readily known to one skilled in the art.

One component optionally included in the bleaching solution is an organic phosphonic acid, polycarboxylic acids (including aminopolycarboxylic acids or pyridinecarboxylic acids) or a salt thereof useful as metal ion sequestering agents, present in an amount of at least 0.0005 mol/l, and preferably at from about 0.001 to about 0.008 mol/l. Useful phosphonic acids and salts thereof are described, for example, in EP 0 428 101A1 (noted above) and copending U.S. Ser. No. 08/230,365 filed Apr. 20, 1994 by Haye et al., now abandoned. Useful polycarboxylic acids are described in numerous publications, and can include diethylenetriaminepentaacetic acid.

It may also be useful to include in the bleaching solution an organic catalyst for the peroxide, as described, in copending and commonly assigned U.S. Ser. No. 08/363,106, filed Dec. 22, 1994, by O'Toole, now U.S. Pat. No. 5,508,106, or a metal ion co-catalyst [such as copper(II) ion] as described in copending and commonly assigned U.S. Ser. No. 08/362,384, filed Dec. 22, 1994, by O'Toole, Sistare and Schmittou, pending.

Other details of conventional peroxide bleaching solutions and their use in various processing methods are provided in *Research Disclosure, publication* 36544, pages 501–544 (September 1994). Research Disclosure is a publication of Kenneth Mason Publications, Ltd., Dudley House, 12 North Street, Emsworth, Hampshire P010 7DQ England (also available from Emsworth Design Inc., 121 West 19th Street, New York, N.Y. 10011). This reference will be referred to hereinafter as "Research Disclosure".

The time for bleaching is generally less than about 30 seconds, and the exact time will vary with the type of element being processed. The temperature at which bleaching is carried out is generally from about 20 to about 45° C.

As used herein in defining concentrations of reagents, $C_A$ and processing times, the term "about" refers to ±20% of the indicated amount. In defining pH and $pK_a$, the term "about" refers to 0.5 unit. In defining temperature, the term "about" refers to ±5° C.

The color photographic elements to be processed using this invention can contain any of the conventional silver halide emulsions, including but not limited to, silver chloride, silver bromide, silver chlorobromide, silver chlorobromoiodide and silver bromoiodide. Silver chloride, silver bromide and silver chlorobromide are preferred. The levels of silver halide in each emulsion layer can be any desired amount, including up to about 3 g/m$^2$. Some useful elements have considerably lower levels, such as less than about 0.8 g/m$^2$.

The elements can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers can be arranged in the element in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. Conventional supports with or without a magnetic backing layer can also be used.

Considerably more details of useful element structure and components, and suitable methods of processing various types of elements are described in "*Research Disclosure*", noted above. All types of emulsions can be used in the elements, including thin tabular grains, and either positive- or negative-working emulsions. The elements can be either photographic color papers, or films.

The elements are typically exposed to suitable radiation to form a latent image and then processed to form a visible dye image. Processing includes a color development step in the presence of one or more color developing agents to reduce developable silver halide and to oxidize the color developing agent. Oxidized color developing agent in turn reacts with a color-forming coupler to yield a dye.

Processing methods of this invention can have any of a variety of combinations of one or more development, stop development (with what is known as a "stop" solution), washing, bleaching, fixing, washing (or stabilizing) steps. Color photographic papers (or prints) and photographic films can be processed using a wide variety of processing methods having a variety of orders of processing steps, as described for example in "*Research Disclosure*", noted above.

In particular, the present invention can include any one of the following protocols of processing steps prior to conventional fixing:

A: development, stop development, washing, alkaline prebath treatment, washing, bleaching and washing.

B: development, stop development, alkaline prebath treatment, washing, bleaching and washing.

C: development, stop development, washing, alkaline prebath treatment, bleaching and washing.

D: development, stop development, alkaline prebath treatment, bleaching and washing.

E: development (as prebath treatment), washing, bleaching and washing.

F: development (as prebath treatment), bleaching and washing.

The processing protocols labeled as A through D are preferred.

Processing according to the present invention can be carried out using conventional processing equipment, including what is known in the art as "low volume thin tank" processing systems, which have either rack and tank or automatic tray designs. Such processing methods and equipment are described, for example, in recently allowed U.S. Ser. No. 08/221,711 (filed Mar. 31, 1994, by Carli et al), now U.S. Pat. No. 5,436,118, and publications noted therein.

The following examples are presented to illustrate the practice of this invention, and are not intended to be limiting in any way. Unless otherwise indicated, all percentages are by weight.

EXAMPLES 1–8

Comparisons of Processing Methods

The processing method of this invention was carried out using various acidic peroxide bleaching solutions and an alkaline prebath solution, and compared to a processing method wherein the use of the alkaline prebath solution was omitted.

Samples of EKTACOLOR EDGE™ Color Paper containing silver chloride emulsions, were exposed for 1/10 with 3000K illumination using a 0 to 3 21-step exposure tablet with HA-50, INC-0.30 and NP-11 filters. The samples were then processed at 35° C. using the processing protocols noted below. Bleaching was considered complete when the residual silver was less than 0.04 g/m$^2$, as measured by X-ray fluorescence using conventional procedures.

| | Comparative Processing Method |
|---|---|
| 45 seconds | Development* |
| 30 seconds | Stop solution (1% v/v, $H_2SO_4$) |
| 30 seconds | Water wash |
| Various times | Bleaching** |
| 45 seconds | Water wash |
| 45 seconds | Fixing*** |
| 90 seconds | Water wash |
| 10 seconds | Rinsing**** |
| | Processing Method of Invention |
| 45 seconds | Development* |
| 30 seconds | Stop solution (1% v/v, $H_2SO_4$) |
| 30 seconds | Water wash |
| Various times | Alkaline prebath treatment# |
| Various times | Water wash |
| Various times | Bleaching** |
| 45 seconds | Water wash |
| 45 seconds | Fixing*** |
| 90 seconds | Water wash |
| 10 seconds | Rinsing**** |

*Development was carried out using a solution (pH 10.1) containing triethanolamine (12.4 g/l), PHORWITE ™ REU optical brightener (2.3 g/l), lithium polystyrene sulfonate (30% solution, 0.3 g/l), N,N-diethylhydroxylamine (4.5 g/l), KODAK ™ Color Developer, CD-3 (5 g/l), potassium carbonate (24.8 g/l), potassium chloride (1.6 g/l), potassium bromide (7 mg/l) and 1-hydroxy-1,1-diphosphonic acid (60% w/w, 1.2 g/l).

**See bleaching solutions described below.

***Fixing with an aqueous solution (pH 6.5) containing a mixture (162 ml/l) of 56.5% of ammonium thiosulfite and 4% ammonium sulfite (162 ml), and sodium metabisulfite (11.8 g/l).

****Rinsing with commercial KODAK ™ PHOTO-FLO ™ 200 concentrate (5 ml/l).

#The alkaline prebath solution (pH 10) was an aqueous solution of sodium carbonate (0.05 mol/l).

Bleaching Solution A was a conventional iron chelate bleaching solution containing a complex of ferric ion with 1,3-propylenediaminetetraacetic acid (0.04 mol/l, 10 mole % excess ligand), potassium bromide (24 g/l) and acetic acid buffer (10 ml/l) and was adjusted to pH 4.75 with potassium hydroxide.

Bleaching Solutions B-H all contained hydrogen peroxide (0.33 mol/l, 1% w/w) and sodium chloride (0.1 mol/l). The pH values (adjusted using sodium hydroxide) and acetic acid buffer concentrations for these solutions are listed in Table I.

Table I below summarizes the various bleaching steps using the various bleaching solutions, and the results obtained for Examples 1–6. The last two columns show the bleaching times (seconds) needed to reach 0.04 g/m$^2$ residual silver in the Dmax and midscale regions of exposure. The developed silver level in the Dmax region was initially between 0.54 and 0.75 g/m$^2$, and the developed silver level in the midscale region was initially between 0.18 and 0.39 g/m$^2$.

TABLE I

| Processing Method | Prebath Time (sec) | Wash Time (sec) | Bleach Solution | Acetic Acid Level (mol/l) | pH | $C_A$ (mmol/l) | Time for Complete Bleaching (seconds) Dmax | midscale |
|---|---|---|---|---|---|---|---|---|
| Control A | — | — | A | — | — | — | 30 | 15 |
| Control B | 0 | 0 | B | 0.05 | 6.0 | 3 | 90 | * |
| Example 1 | 60 | 60 | B | 0.05 | 6.0 | 3 | 15 | 15 |
| Example 2 | 60 | 0 | B | 0.05 | 6.0 | 3 | 15 | 15 |
| Example 3 | 30 | 0 | B | 0.05 | 6.0 | 3 | 15 | 15 |
| Example 4 | 15 | 0 | B | 0.05 | 6.0 | 3 | 15 | 30 |
| Control C | 0 | 0 | C | 0.1 | 6.0 | 6 | * | * |
| Example 5 | 60 | 0 | C | 0.1 | 6.0 | 6 | 15 | 15 |
| Control D | 0 | 0 | D | 0.003 | 3.5 | 3 | * | * |
| Example 6 | 60 | 0 | D | 0.003 | 3.5 | 3 | 15 | 15 |
| Control E | 60 | 60 | E | 0.05 | 5.0 | 18 | 15 | * |
| Control F | 60 | 60 | F | 0.05 | 4.0 | 42 | * | * |
| Control G | 60 | 60 | G | 0.015 | 3.4 | 15 | 15 | * |
| Control H | 60 | 60 | H | 0.03 | 3.3 | 30 | * | * |

*Bleaching not complete within 90 seconds.

The data shown above indicate that rapid (less than 30 seconds) bleaching was achieved in all of the Examples. No vesiculation was observed with the practice of the present invention.

Although the conventional ferric bleaching solution (Control A) was also highly effective, it is an object of this invention to provide an equally effective alternative that is more ecologically acceptable.

Comparisons of Control B to Examples 1–4, Control C to Example 5, and Control D to Example 6, clearly illustrate the unexpected benefits of the alkaline prebath on bleaching performance according to this invention. Example 1 illustrates that the benefits of the alkaline prebath are maintained even when an intermediate washing step is used. Even with the use of the alkaline prebath, however, Controls E-H illustrate that if the bleaching solution buffer capacity, $C_A$, is too high, incomplete bleaching will occur. It is clear from all of the data in Table I that it is the bleaching solution buffer capacity ($C_A$), not pH, that primarily controls the effectiveness of bleaching.

In Control I (not shown in Table I), the method of Example 2 was used except that, following the alkaline prebath and washing steps, the photographic element was treated with conventional acidic stop bath (60 seconds) and washing (60 seconds) steps, and then immersed in Bleaching Solution B. No bleaching was observed after 90 seconds in either the Dmax or midscale regions. Control I illustrates that the beneficial effects of using an alkaline prebath solution can be undone by using an acidic solution immediately thereafter. Thus, any intermediate steps (between prebath and bleaching) must be carried out with solutions that are generally neutral in pH as well as having low ion content.

Example 7 was a method carried out similar to Example 2 except that the prebath pH was 11 instead of 10. Complete bleaching of both the midscale and Dmax regions was accomplished within 15 seconds.

In Example 8, the color developing solution was used as the alkaline prebath solution. Thus, in the processing protocol described above, the separate alkaline prebath and following washing steps were omitted. The rest of the process was the same. It was observed that complete bleaching in both the midscale and Dmax regions was achieved in 30 and 15 seconds, respectively, although with minor vesiculation.

EXAMPLE 9

Processing of DURACLEAR Elements

This Example demonstrates the practice of this invention to process samples of DURACLEAR™ silver chloride color photographic print film. A comparative processing method was also evaluated.

Samples of the element were exposed for ⅕ second using a 0 to 3 21-step tablet with HA-50, INC-0.30 and NP-11 filters and 3000K illumination. The samples were then processed at 35° C. using the processing method of this invention as described in Examples 1–6 except that the development time was 90 seconds. Bleaching was considered complete when the residual silver was less than 0.05 $g/m^2$ as measured by X-ray fluorescence using conventional procedures.

A Control J processing method was carried out using the conventional Bleaching Solution A described above in Examples 1–6. A Control K processing method was also carried out like Control B described above.

The method of this invention (Example 9) was carried out like Example 2 described above.

Table II below shows the results of these processing methods, that is, times (seconds) for complete bleaching in the Dmax and midscale regions. The developed silver level in the Dmax region was initially 1.74 $g/m^2$, and the developed silver level in the midscale region was initially 0.84 $g/m^2$.

TABLE II

| Processing | Prebath | Wash | Bleach | Acetic Acid | | $C_A$ | Time for Complete Bleaching (seconds) | |
|---|---|---|---|---|---|---|---|---|
| Method | Time (sec) | Time (sec) | Solution | Level (mol/l) | pH | (mmol/l) | Dmax | midscale |
| Control J | — | — | A | — | — | — | 90 | 45 |
| Control K | 0 | 0 | B | 0.05 | 6.0 | 3 | * | * |
| Example 9 | 60 | 0 | B | 0.05 | 6.0 | 3 | 30 | 30 |

*Bleaching not complete within 90 seconds.

The data show that the present invention provided rapid (within 30 seconds) bleaching for both regions. Control K shows that, without the prebath solution, bleaching was not complete within 90 seconds in either region. Bleaching with the conventional ferric chelate bleaching solution was complete within 90 seconds, but the solution is undesirable for reasons noted above (less ecologically desirable).

EXAMPLE 10

Processing of Color Print Film

This example demonstrates the practice of this invention to effectively bleach EASTMAN COLOR PRINT FILM™ (a color motion picture film) that contains about 25 mole % silver bromide and about 75 mole % silver chloride. Samples of this film were exposed on a camera speed sensitometer for 1/500 second using a 0 to 4 density, 21-step tablet and HA-50 and HA-1700 filters and 3000K illumination.

The samples were then processed at 36.7° C. using the following processing protocol:

| | |
|---|---|
| 10 seconds | Remjet softener* |
| 20 seconds | Water wash |
| 3 minutes | Development** |
| 40 seconds | Stop solution (1% v/v, $H_2SO_4$) |
| 40 seconds | Water wash |
| 40 seconds | Alkaline prebath treatment# |
| 60 seconds | Bleaching*** |
| 60 seconds | Water wash |
| 45 seconds | Fixing**** |
| 60 seconds | Water wash |
| 10 seconds | Rinsing## |

-continued

*The Remjet softener composition (per liter) comprised sodium borate (20 g) and sodium sulfate (100 g) and had a pH of 9.25.
**Development was carried out using a solution (per liter, pH 10.53) containing aminotris(methylenephosphonic acid), pentasodium salt (1 ml, 40% w/w), KODAK ™ Color Developer, CD-2 (2.95 g), sodium carbonate (17.1 g), sodium sulfite (4.3 g) and sodium bromide (1.7 g).
***See bleaching solutions described below.
****Fixing with an aqueous solution (per liter, pH 5) containing a mixture (100 ml) of ammonium thiosulfite (56.6%) and ammonium sulfite (4%), and sodium metabisulfite (13 g).
#The prebath solution was an aqueous solution of sodium carbonate (0.05 mol/l) and had a pH of 10.
Rinsing with commercial KODAK ™ PHOTO-FLO ™ 200 concentrate (5 ml/l).

A Control L processing method used Bleaching Solution I that was a conventional ferricyanide bleaching solution containing sodium bromide (17 g/l) and potassium ferricyanide (30 g/l) and having a pH of 6.5. The alkaline prebath treatment step was omitted from this processing method.

In a Control M processing method, bleaching was carried out using Bleaching Solution J comprised of hydrogen peroxide (0.66 mol/l, 2% w/w), sodium chloride (0.1 mol/l) and acetic acid (0,003 mol/l) and had a pH of 3.5. The alkaline prebath treatment was omitted.

In Example 10, the hydrogen peroxide bleaching solution described for the Control J method was used, as well as the alkaline prebath treatment described above.

Table III below shows the residual silver levels after bleaching using these processing methods. The initial silver levels in the Dmax and midscale regions were 1.60 and 0.27 g/m$^2$, respectively. Bleaching was considered complete when the residual silver was less than 0.05 g/m$^2$.

TABLE III

| Processing Method | Prebath Time (sec) | Wash Time (sec) | Bleach Solution | Acetic Acid Level (mol/l) | pH | $C_A$ (mmol/l) | Residual silver after 60-second bleach (g/m$^2$) Dmax | midscale |
|---|---|---|---|---|---|---|---|---|
| Control L | — | — | I | — | 6.5 | — | 0.01 | 0.00 |
| Control M | 0 | 0 | J | 0.003 | 3.5 | 3 | 1.17 | 0.26 |
| Example 10 | 40 | 0 | J | 0.003 | 3.5 | 3 | 0.01 | 0.00 |

It is apparent from the results that bleaching was rapid for both the Control K and Example 10 methods. However, Control K is undesirable because of the use of an iron-based bleaching solution that has harmful environmental effects. The Control L method provided little bleaching after 60 seconds within either region. Thus, the alkaline prebath treatment is clearly needed to provide the rapid bleaching desired.

It was observed that the alkaline prebath treatment used in the practice of the present invention cannot be used in the conventional EASTMAN COLOR PRINT™ Film process because the first fixing solution normally used in that process poisons the system. However, the present invention may be useful in the processing of color print films where the sound tracks are digitally or magnetically recorded.

EXAMPLE 11

Stability Comparisons

Several bleaching solutions used in the practice of this invention were compared for stability after keeping at 35° C. in glass containers. The compared bleaching solutions were those identified above as Bleaching Solutions B and D, and herein below as Bleaching Solutions K, L and M.

Bleaching Solution K contained hydrogen peroxide (0.33 mol/l, 1% w/w), acetic acid (0.05 mol/l), sodium chloride (0.1 mol/l) and 1 -hydroxyethyl-1,1-diphosphonic acid (1 ml, 60% w/w), and was adjusted to pH 6.0.

Bleaching Solution L contained hydrogen peroxide (0.33 mol/l, 1% w/w), sodium bicarbonate (0.05 mol/l), and sodium chloride (0.35 mol/l) and was adjusted to pH 10.0 with sodium hydroxide.

Bleaching Solution M contained hydrogen peroxide (0.33 mol/l, 1% w/w), sodium bicarbonate (0.05 mol/l), sodium chloride (0.35 mol/l) and 1-hydroxyethyl-1,1-diphosphonic acid (1 ml, 60% w/w), and was adjusted to pH 10.0 with sodium hydroxide.

From the data displayed in the FIGURE illustrating the loss in hydrogen peroxide level over time, it is clear that the acidic Bleaching Solutions B, D and K used in this invention, are much more stable over time than the alkaline Bleaching Solutions L and M that are similar to those described in EP-A-0 428 101.

The invention has been described in detail with particular reference to preferred embodiments thereof, but it will be understood that variations and modifications can be effected within the spirit and scope of the invention.

We claim:

1. A method for processing a color silver halide photographic element, comprising:

A) subsequently to or simultaneously with color development, treating an imagewise exposed color silver halide photographic element with an alkaline prebath solution, and B) bleaching said treated element with an acidic, rehalogenating peroxide bleaching solution that has a buffer capacity, $C_A$, of less than about 0.05 mol/l, and comprises chloride ion in an amount of from about 0.01 to about 1 mol/l.

2. The method of claim 1 wherein said alkaline prebath solution has a pH of from about 9 to about 13.

3. The method of claim 1 wherein said alkaline prebath solution has a pH of from about 10 to about 11.

4. The method of claim 1 wherein said alkaline prebath solution comprises a carbonate buffer.

5. The method of claim 1 wherein said bleaching solution comprises hydrogen peroxide, and has a pH of from about 2 to about 7.

6. The method of claim 1 wherein said bleaching solution has a pH of from about 2 to about 6.

7. The method of claim 1 carried out in a low volume thin tank processor.

8. The method of claim 1 for the processing of a silver halide photographic element having less than about 0.8 g/m$^2$ of silver halide.

9. The method of claim 1 wherein said bleaching solution has a buffer capacity of less than about 0.01 mol/l.

10. The method of claim 1 wherein said bleaching solution comprises an acetate buffer.

11. The method of claim 1 wherein said alkaline prebath solution is a color developer solution containing a color developing agent.

12. The method of claim 1 for the processing of a color silver halide photographic paper.

13. A method for processing a color silver halide photographic element, comprising:

A) color developing an imagewise exposed color silver halide photographic element, B) stopping color development with a development stop solution, C) treating said imagewise exposed and developed color silver halide photographic element with an alkaline prebath solution, and D) bleaching said element with an acidic rehalogenating peroxide bleaching solution that has a buffer capacity, $C_A$, of less than about 0.05 mol/l, and comprises chloride ion in an amount of from about 0.01 to about 1 mol/l.

14. The method of claim 13 wherein said bleaching step D is carried out for less than about 30 seconds.

15. The method of claim 13 further comprising a washing step between steps C and D.

16. The method of claim 13 wherein said alkaline prebath solution has a pH of from about 10 to about 11 and contains a carbonate buffer.

17. The method of claim 13 wherein said bleaching solution is buffered to a pH of from about 3 to about 5, comprises hydrogen peroxide in an amount of from about 0.1 to about 1 mol/l and chloride ion in an amount of from about 0.01 to about 0.5 mol/l, and has a buffer capacity, $C_A$, of less than about 0.01 mol/l.

18. The method of claim 17 wherein said bleaching solution has a buffer capacity of less than about 0.005 mol/l.

19. The method of claim 17 wherein said bleaching solution comprises chloride ion in an amount of from about 0.035 to about 0.35 mol/l.

20. The method of claim 13 wherein said bleaching solution further comprises a phosphonic acid or polycarboxylic acid metal ion sequestering agent.

21. The method of claim 13 wherein said treating step C is carried out for from about 10 to about 60 seconds, and said bleaching step D is carried out in less than about 60 seconds.

22. The method of claim 8 wherein said silver halide photographic element is a color photographic paper having a silver chloride, silver bromide or silver chlorobromide emulsion.

* * * * *